US011525233B1

(12) United States Patent
Verley et al.

(10) Patent No.: US 11,525,233 B1
(45) Date of Patent: Dec. 13, 2022

(54) SYSTEM OF ENGINEERED POST TENSIONED FOOTING AND STEM WALL FOUNDATION BLOCKS

(71) Applicant: PMEE International, Sandy, OR (US)

(72) Inventors: Christopher M. Verley, Sandy, OR (US); Gabriel Kerslake, Gresham, OR (US)

(73) Assignee: PMEE INTERNATIONAL, LLC, Sandy, OR (US)

( * ) Notice: Subject to any disclaimer, the term of this patent is extended or adjusted under 35 U.S.C. 154(b) by 0 days.

(21) Appl. No.: 17/230,814

(22) Filed: Apr. 14, 2021

Related U.S. Application Data

(60) Provisional application No. 63/055,793, filed on Jul. 23, 2020.

(51) Int. Cl.
*E02D 27/01* (2006.01)
*E04B 2/02* (2006.01)

(52) U.S. Cl.
CPC ..... *E02D 27/016* (2013.01); *E04B 2/02* (2013.01); *E02D 2300/002* (2013.01)

(58) Field of Classification Search
CPC ..... E02D 27/016; E04B 2/02
USPC ..... 52/293.1, 293.2, 293.3
See application file for complete search history.

(56) References Cited

U.S. PATENT DOCUMENTS 1,514,081 A * 11/1924 Hahn ..... E04B 2/04 405/273
1,527,684 A * 2/1925 Hull ..... E04B 2/04 52/574
1,704,255 A * 3/1929 Lewis ..... E04B 2/16 52/286
1,707,858 A * 4/1929 Hurlbert ..... E04B 2/56 52/274
3,410,044 A * 11/1968 Moog ..... E04C 1/40 52/439
3,685,241 A * 8/1972 Cooper ..... E04B 1/04 52/270

(Continued)

FOREIGN PATENT DOCUMENTS

EP 1196662 B1 1/2007
KR 102198307 B1 * 1/2021
MX 2014015144 A 11/2015

*Primary Examiner* — Frederick L Lagman

(57) ABSTRACT

A system of stem wall foundation blocks is a set of reinforced precast, post-tensioned modular footing and stem wall foundation blocks with a unique interconnecting design optimized for both residential and commercial applications that eliminates the need for on-site manufacturing of a foundation mold. The apparatus provides a unique modular foundation design for a variety of applications within construction. A series of wall blocks of different shapes and arrangements interlock, thus enabling users to modify the dimensions of their foundation mold to a desired purpose. Engineered bolts and lapped connections enable the modular wall pieces to securely connect after they have interlocked. This arrangement enables construction workers to move the interlocking blocks into position and then begin pouring concrete inside to lay the foundation. The reinforced precast, post-tension modular footing, and stem wall foundation blocks are less expensive and more efficient for building and constructing residential and commercial foundations.

13 Claims, 8 Drawing Sheets

(56) References Cited

U.S. PATENT DOCUMENTS 4,297,816 A * 11/1981 Kella ..... E04C 1/40 52/309.8
4,860,505 A * 8/1989 Bender ..... E02D 29/025 52/592.6
5,367,845 A * 11/1994 Hartling ..... E02D 27/02 52/294
5,802,796 A * 9/1998 McClinton ..... E04B 2/14 52/591.1
6,035,599 A * 3/2000 Sonnentag ..... E04C 1/395 52/285.4
6,098,357 A * 8/2000 Franklin ..... E04B 2/52 52/439
6,141,933 A * 11/2000 McClinton ..... B28B 11/044 52/591.1
6,244,009 B1 * 6/2001 Cerrato ..... E04H 9/021 52/592.1
6,539,682 B1 4/2003 Ryder
6,758,020 B2 * 7/2004 Cerrato ..... E04C 3/02 52/590.3
6,955,015 B2 * 10/2005 Manthei ..... E04B 2/06 52/584.1
8,061,095 B2 * 11/2011 Bucheger ..... E04B 2/44 52/607
2002/0046521 A1 * 4/2002 Steinacker, Sr. ..... E02D 27/02 52/274
2008/0120931 A1 * 5/2008 Joslyn ..... E04B 2/24 52/293.3
2009/0288355 A1 11/2009 Platt et al.
2019/0360197 A1 11/2019 Wawi

* cited by examiner

SYSTEM OF ENGINEERED POST TENSIONED FOOTING AND STEM WALL FOUNDATION BLOCKS

The current application claims a priority to the U.S. Provisional Patent application Ser. No. 63/055,793 filed on Jul. 23, 2020.

FIELD OF THE INVENTION

The present invention relates to building and construction. More specifically, the system of stem wall foundation blocks relates to a set of precast, post-tensioned stem wall foundation blocks with a unique interconnecting design, thus enabling modular arrangement of blocks to form an appropriate building foundation on a construction site.

BACKGROUND OF THE INVENTION

The advent of advancements in construction technology and processes has resulted in a corresponding increase in the demand for buildings of all shapes and sizes. Regardless of the type of building, it is common practice to begin construction by laying a foundation of concrete. In order to build such a foundation, the perimeter of the building must be outlined by a temporary border wall, which serves as a mold into which concrete may be poured. This tried-and-true method results in an even, consistently-shaped foundation that is prepared to support a larger structure.

However, the development of the temporary border wall requires a significant amount of time and resources. Each foundation is different depending on the different conditions and requirements set forth by the project. Currently, the best solution to this problem is to manufacture the appropriate foundation block on site and in the appropriate position. This is very time-consuming, not only to measure and execute on the dimensions of the necessary foundation mold, but also in terms of the time cost of failure, as starting over requires removal of the original failed foundation mold. Further, the mold walls must be put under tension, a process which ensures that they will retain their shape as the concrete foundation is poured and hardens, but which also requires additional time and resources to perform. What is needed is a set of modular blocks that are manufactured and assembled appropriately into the appropriate mold wall configuration. Further desirable is a set of building blocks which are already in a post-tension state, thus requiring only the adjustment of the blocks into the appropriate mold shape on the construction site.

The present invention addresses these issues. The system of stem wall foundation blocks is a set of reinforced precast, post-tensioned modular footing and stem wall foundation blocks with unique interconnecting design for residential and commercial application. A series of wall blocks of different shapes and arrangements interlock, thus enabling users to modify the dimensions of their foundation mold to a desired purpose. Engineered bolts and lapped connections enable the modular wall pieces to securely connect after they have interlocked. This arrangement enables construction workers to move the interlocking blocks into position and then begin pouring concrete inside to lay the foundation. The reinforced precast, post-tension modular footing, and stem wall foundation blocks are less expensive and more efficient for building and constructing residential and commercial foundations.

DETAILED DESCRIPTION OF THE INVENTION

All illustrations of the drawings are for the purpose of describing selected versions of the present invention and are not intended to limit the scope of the present invention.

Figure 1:
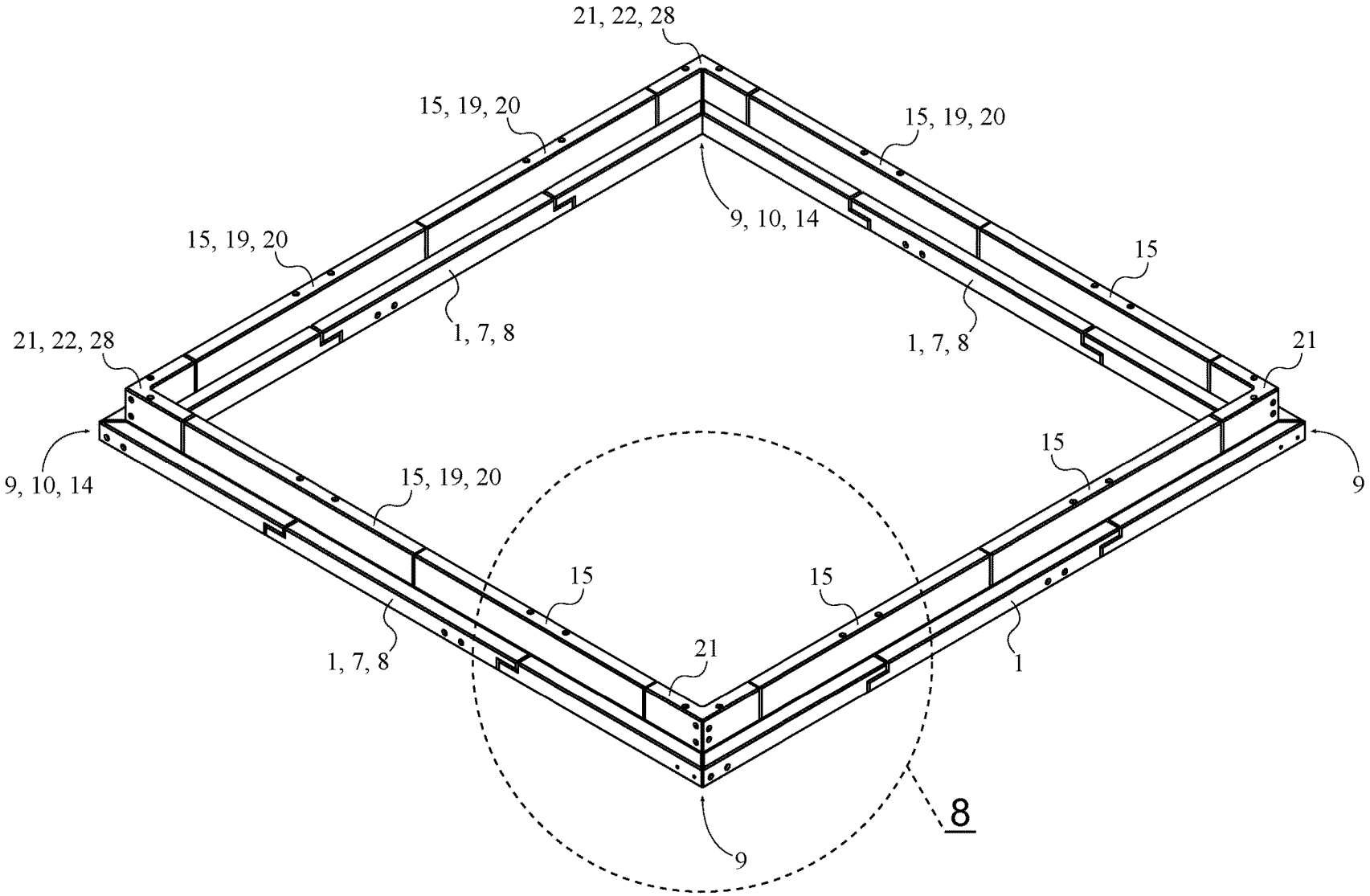
FIG. 1 is a top perspective view of the present invention.

The present invention is a system of stem wall foundation blocks that is used to create a stem wall mold for subsequent pouring of a foundation during early-stage building construction. The present invention is configured to provide interlocking pre-tensioned blocks that are prepared for on-site arrangement. The present invention comprises a plurality of intermediate-base blocks 1, a plurality of corner-base block assemblies 9, a plurality of intermediate-wall blocks 15, and a plurality of corner-wall blocks 21, as shown in FIG. 1. The plurality of intermediate-base blocks 1 relates to a set of stem wall blocks that is configured to interlock between adjacent corner-base block assemblies of the plurality of corner-base block assemblies 9. The plurality of corner-base block assemblies 9 relates to a set of stem wall blocks that is configured to interlock between an adjacent intermediate-base block 8 of the plurality of intermediate-base blocks 1, thus defining the perimeter of the foundation. The plurality of intermediate-wall blocks 15 is a set of stem wall blocks arranged generally atop a corresponding block of the plurality of intermediate-wall blocks 15 that creates a flat surface against which, in the preferred usage of the present invention, concrete may be poured. While concrete is a common material that applies to the present invention, other materials, including composites, resins, reinforced materials, recycled material, and more may be used, and references to concrete herein may refer to any of these materials. The plurality of corner-wall blocks 21 is a set of stem wall blocks arranged generally atop a corresponding block of the plurality of corner-base block assemblies 9 that creates a flat surface against which, in the preferred usage of the present invention, concrete may be poured.

Figure 2:
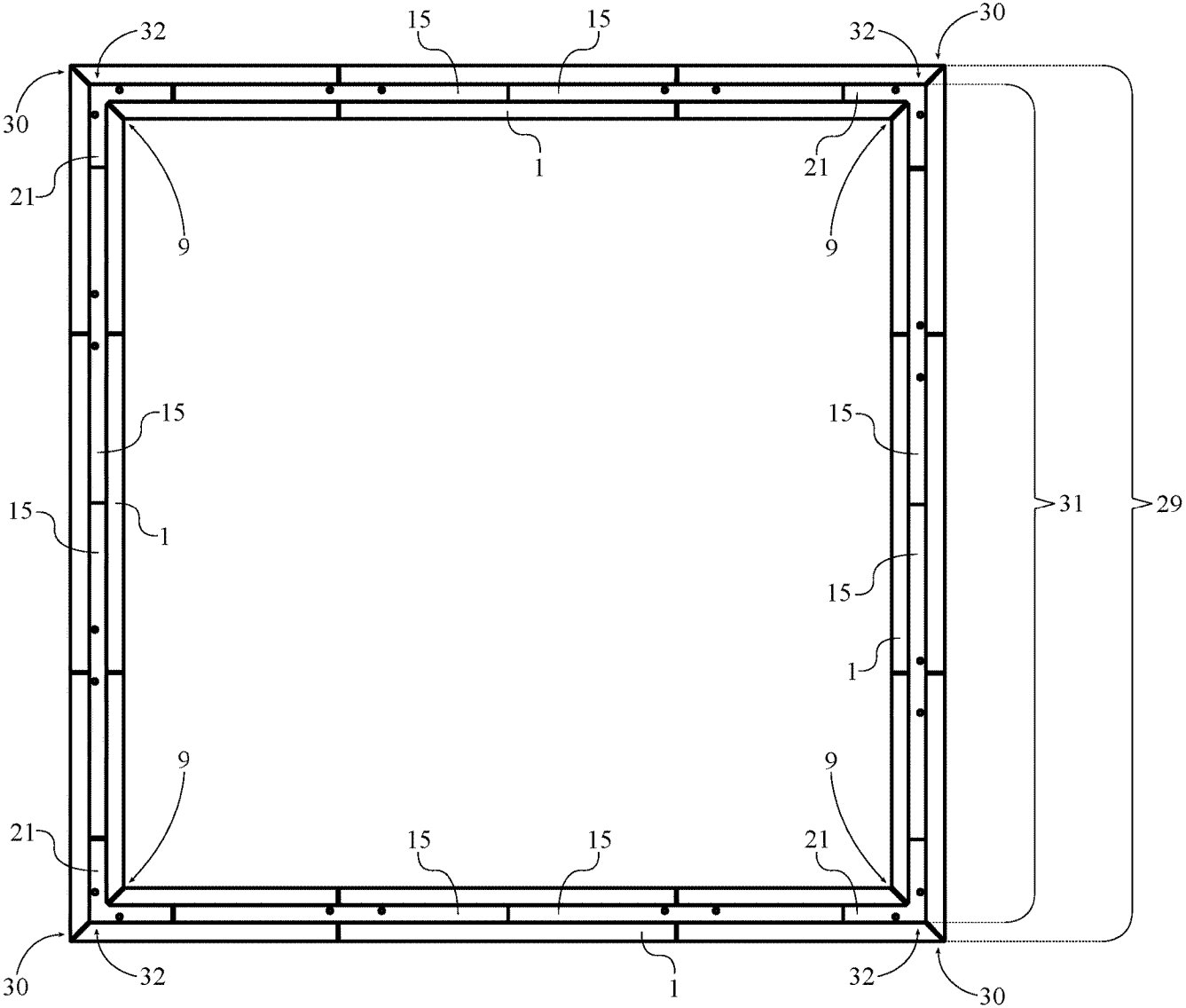
FIG. 2 is a top view of the present invention.

The general configuration of the aforementioned components allows the present invention to efficiently and effectively define a building foundation perimeter and brace for subsequent concrete pouring. The plurality of intermediate-base blocks 1 and the plurality of corner-base block assemblies 9 are arranged into a rectangular base enclosure 29, as shown in FIG. 2, wherein the rectangular base enclosure 29 may comprise a plurality of base enclosure vertices 30. The plurality of base enclosure vertices 30 is the set of points which geometrically represent the corners of the plurality of corner-base block assemblies 9. The rectangular base enclosure 29 formed by the plurality of intermediate-base blocks 1 and the plurality of corner-base block assemblies 9 is the resultant area created from interlocking the plurality of intermediate-base blocks 1 and the plurality of corner-base block assemblies 9 together. The plurality of intermediate-base blocks 1 is positioned in between the plurality of base enclosure vertices 30. In this way, the plurality of intermediate-base blocks 1 may join together to form walls of indefinite length, thus enabling modification of the dimensions of the rectangular base enclosure 29. The plurality of corner-base block assemblies 9 is positioned at the plurality of base enclosure vertices 30. In this way, the plurality of corner-base block assemblies 9 defines the corners of the rectangular base enclosure 29. The plurality of intermediate-wall blocks 15 and the plurality of corner-wall blocks 21 are arranged into a rectangular wall enclosure 31, wherein the rectangular wall enclosure 31 may comprise a plurality of wall enclosure vertices 32. The plurality of wall enclosure vertices 32 is the set of points which geometrically represent the corners of the plurality of corner-wall blocks 21. The rectangular wall enclosure 31 formed by the plurality of intermediate-wall blocks 15 and the plurality of corner-wall blocks 21 is the resultant area created from interlocking the plurality of intermediate-wall blocks 15 and the plurality of corner-wall blocks 21 together. The plurality of intermediate-wall blocks 15 is positioned in between the plurality of wall enclosure vertices 32. In this way, the plurality of intermediate-wall blocks 15 may join together to form walls of indefinite length, thus enabling modification of the dimensions of the rectangular wall enclosure 31. The plurality of corner-wall blocks 21 is positioned at the plurality of wall enclosure vertices 32. In this way, the plurality of corner-wall blocks 21 defines the corners of the rectangular wall enclosure 31. The rectangular wall enclosure 31 is mounted onto the rectangular base enclosure 29. Thus, the plurality of intermediate-base blocks 1 and the plurality of corner-base block assemblies 9 are aligned with the plurality of intermediate-wall blocks 15 and the plurality of corner-wall blocks 21.

Figure 3:
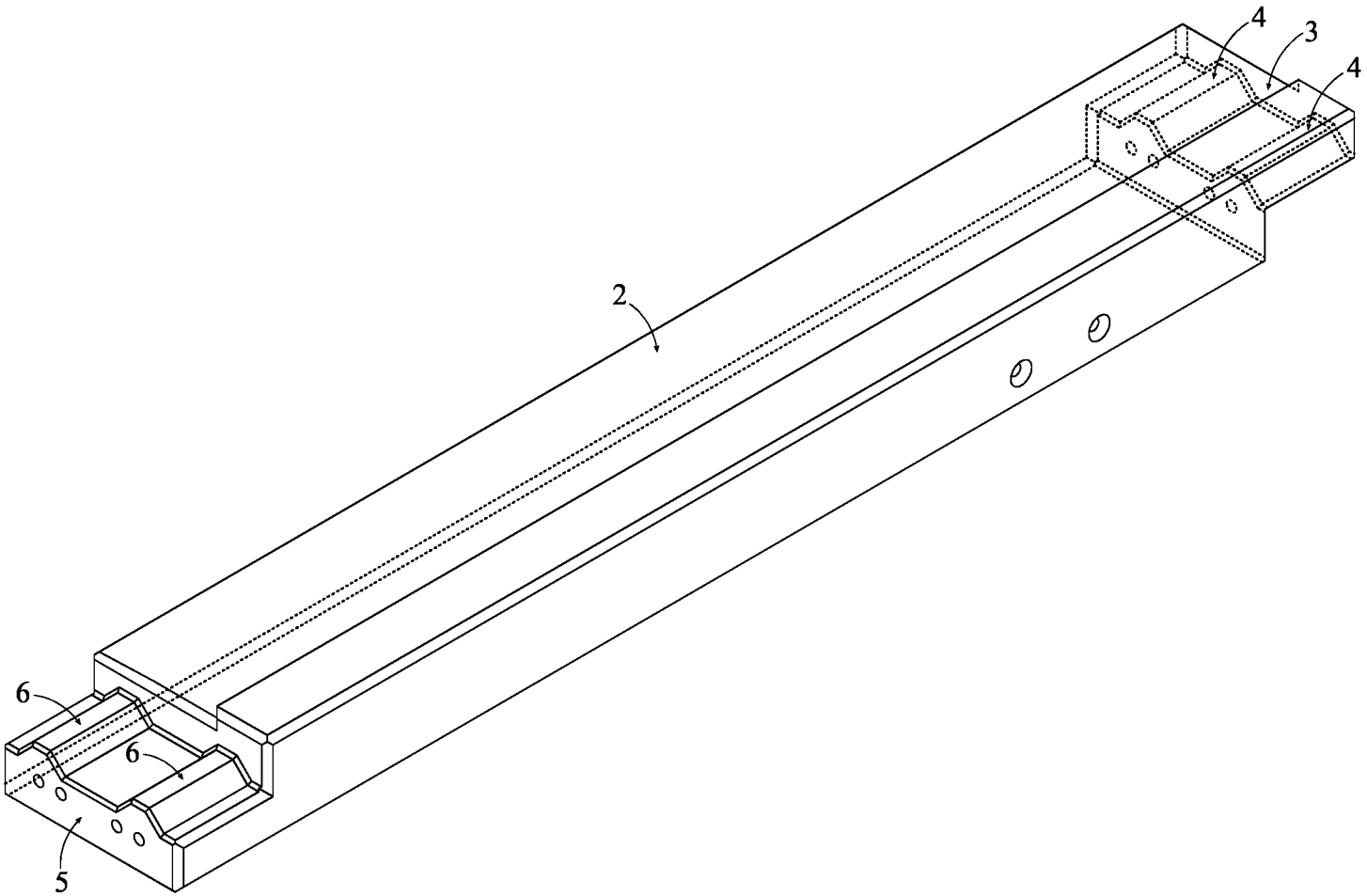
FIG. 3 is a top perspective view of an intermediate-base body of the present invention.

The plurality of intermediate-base blocks 1 must outline the perimeter within which concrete may be poured to create a building foundation. To this end, each of the plurality of intermediate-base blocks 1 may comprise an intermediate-base elongated body 2, an intermediate-base overlap connector 3, and an intermediate-base underlap connector 5, as shown in FIG. 3. The intermediate-base elongated body 2 represents the volume occupied by each of the plurality of intermediate-base blocks 1. The intermediate-base overlap connector 3 is a rigid extrusion which enables each of the plurality of intermediate-base blocks 1 to connect from atop a corresponding connector of an adjacent block. The intermediate-base underlap connector 5 is a rigid extrusion which enables each of the plurality of intermediate-base blocks 1 to connect from beneath a corresponding connector of an adjacent block. The intermediate-base overlap connector 3 is terminally integrated into the intermediate-base elongated body 2. This arrangement enables end-to-end connection of each of the plurality of intermediate-base blocks 1 to an adjacent block on one end. Conversely, the intermediate-base underlap connector 5 is terminally integrated into the intermediate-base elongated body 2, opposite the intermediate-base overlap connector 3. This arrangement enables end-to-end connection of each of the plurality of intermediate-base blocks 1 to an adjacent block on the end opposite the intermediate-base overlap connector 3.

Figure 4:
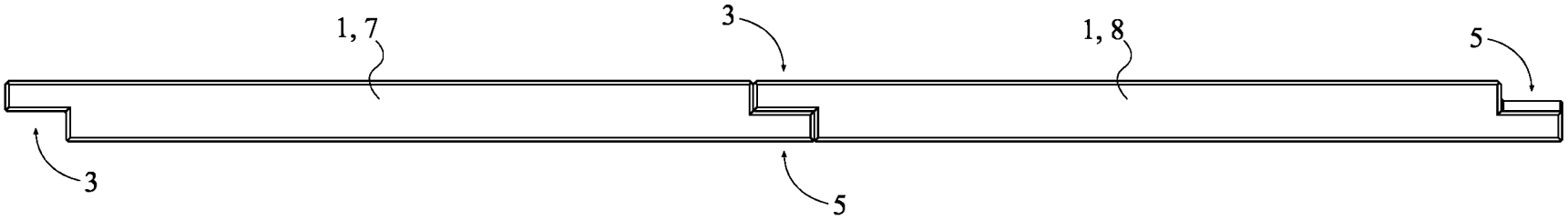
FIG. 4 is a side view of the present invention showing overlap of intermediate-base blocks.

The plurality of intermediate-base blocks 1 may connect to an adjacent intermediate-base block 8 of the plurality of intermediate-base blocks 1 in order to lengthen the size of the created wall. To enable this, the plurality of intermediate-base blocks 1 may comprise an arbitrary intermediate-base block 7 and an adjacent intermediate-base block 8, as shown in FIG. 4. The arbitrary intermediate-base block 7 denotes any given block from the plurality of intermediate-base blocks 1. The adjacent intermediate-base block 8 is a block from the plurality of intermediate-base blocks 1 that is positioned next to the arbitrary intermediate-base block 7. The intermediate-base elongated body 2 of the arbitrary intermediate-base block 7 is positioned colinear to the intermediate-base elongated body 2 of the adjacent intermediate-base block 8. This arrangement enables the appropriate end-to-end alignment necessary for connecting the arbitrary intermediate-base block 7 to the adjacent intermediate-base block 8. The intermediate-base overlap connector 3 of the arbitrary intermediate-base block 7 is engaged to the intermediate-base underlap connector 5 of the adjacent intermediate-base block 8. Thus, the arbitrary intermediate-base block 7 is joined to the adjacent intermediate-base block 8.

The plurality of intermediate-base blocks 1 may also connect via an overlap connector to an adjacent corner-base block assembly of the plurality of corner-base block assemblies 9 in order to complete a created wall, as shown in FIG. 2. To this end, the plurality of intermediate-base blocks 1 may comprise an arbitrary intermediate-base block 7. Further, the plurality of corner-base block assemblies 9 may comprise an adjacent corner-base block assembly 10. The adjacent corner-base block assembly 10 is a block assembly from the plurality of corner-base block assemblies 9 that is positioned next to the arbitrary intermediate-base block 7. The intermediate-base overlap connector 3 of the arbitrary intermediate-base block 7 is engaged to a corner-base underlap feature 33 of the adjacent corner-base block assembly 10. In this way, the arbitrary intermediate-base block 7 is connected atop the adjacent corner-base block assembly 10.

Furthermore, the plurality of intermediate-base blocks 1 may connect via an underlap feature to an adjacent corner-base block assembly of the plurality of corner-base block assemblies 9 in order to complete a created wall, as shown in FIG. 1. To this end, the plurality of intermediate-base blocks 1 may comprise an arbitrary intermediate-base block 7. Further, the plurality of corner-base block assemblies 9 may comprise an adjacent corner-base block assembly 10. The intermediate-base underlap connector 5 of the arbitrary intermediate-base block 7 is engaged to a corner-base overlap feature 11 of the adjacent corner-base block assembly 10. In this way, the arbitrary intermediate-base block 7 is connected below the adjacent corner-base block assembly 10.

Interlocking adjacent members require a mechanism to prevent separation during the concrete pouring and drying processes. To enable this, the intermediate-base overlap connector 3 may comprise a plurality of recessed channels 4, as shown in FIG. 3. The plurality of recessed channels 4 is a linear pattern of cuts through the intermediate-base overlap connector 3 that enable improved connection of adjacent members. Furthermore, the intermediate-base underlap connector 5 may comprise a plurality of elongated protrusions 6. The plurality of elongated protrusions 6 relates to a linear pattern of extruded rigid segments connected to the intermediate-base underlap connector 5 that, in combination with the plurality of recessed channels 4, enables improved connection of adjacent members. Each of the plurality of recessed channels 4 and each of the plurality of elongated protrusions 6 is positioned parallel to the intermediate-base elongated body 2. In this way, the plurality of recessed channels 4 and the plurality of elongated protrusions 6 are oriented to prevent lateral movement when interlocked. The plurality of recessed channels 4 is distributed across the intermediate-base overlap connector 3. This maximizes the surface area of the plurality of recessed channels 4 available for interlocking. The plurality of elongated protrusions 6 is distributed across the intermediate-base underlap connector 5. This maximizes the surface area of the plurality of elongated protrusions 6 available for interlocking. Each of the plurality of elongated protrusions 6 is sized to coextensively fit into a corresponding channel from the plurality of recessed channels 4. Thus, the plurality of recessed channels 4 and the plurality of elongated protrusions 6 prevent shifting of adjacent blocks due to outward pressure from poured or solidifying concrete.

Figure 5:
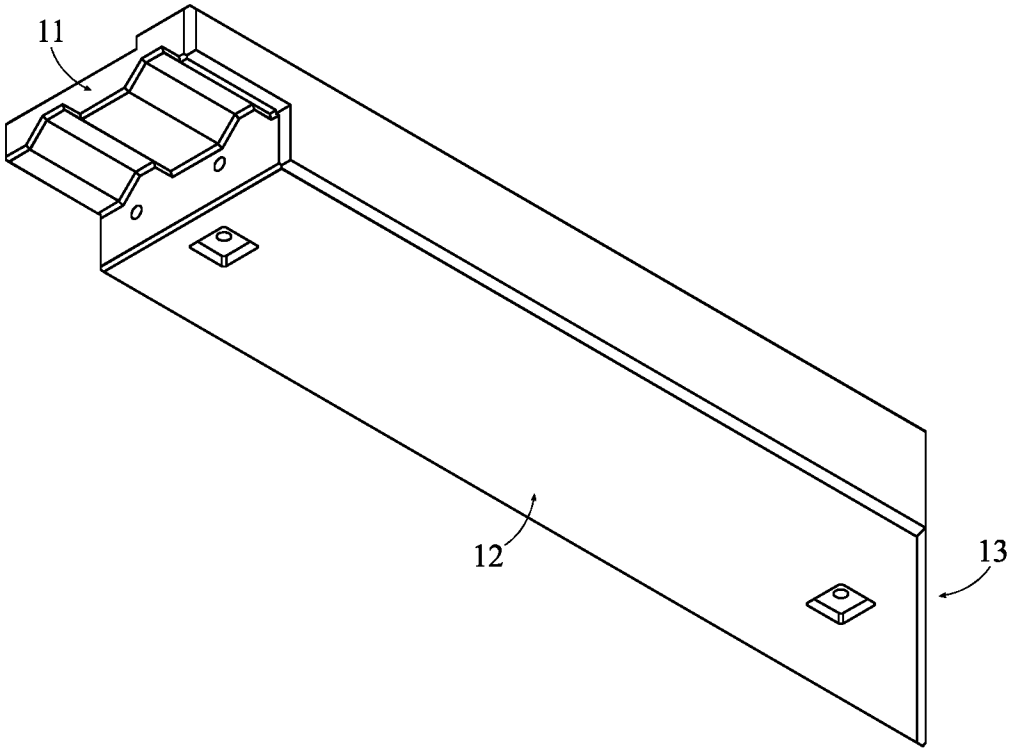
FIG. 5 is a bottom perspective view of a corner base feature of the present invention.
Figure 8:
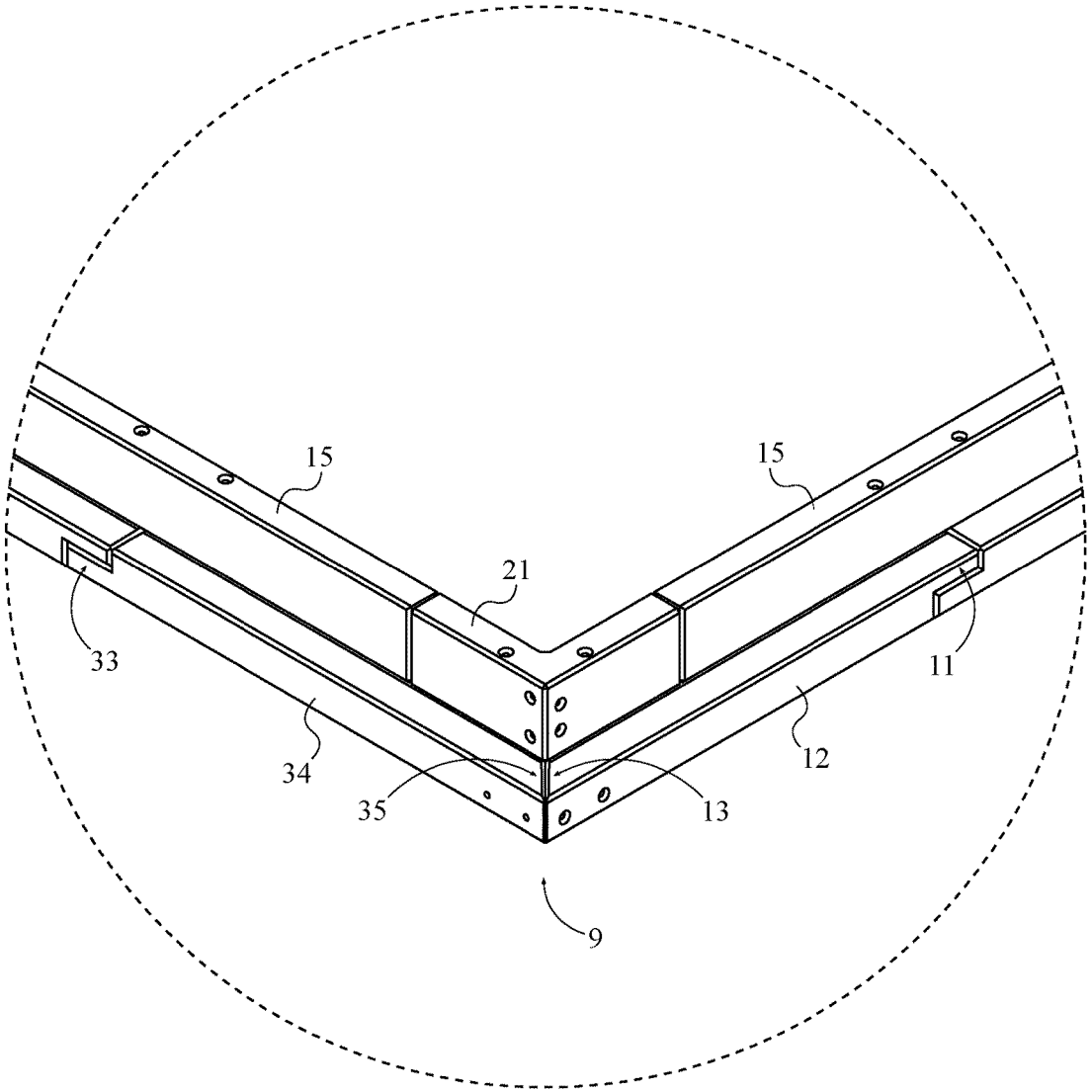
FIG. 8 is a magnified view taken about circle 8 in FIG. 1.

The plurality of corner-base block assemblies 9 must both define the perimeter of the building foundation and be capable of arranging the plurality of intermediate-base blocks 1 appropriately. To enable this, each of the plurality of corner-base block assemblies 9 may comprise a first corner-base elongated block 12, a corner-base overlap feature 11, and a first corner-base slant feature 13, as shown in FIGS. 5 and 8. Each of the plurality of corner-base blocks assemblies 9 may further comprise a second corner-base elongated block 34, a corner-base underlap feature 33, and a second corner-base slant feature 35, as shown in FIG. 8. The first corner-base elongated block 12 and the second corner-base elongated block 34 relate to the volume occupied by each of the plurality of corner-base block assemblies 9. The corner-base overlap feature 11 and the corner-base underlap feature 33 are connectors that allow each of the plurality of corner-base block assemblies 9 to join to an adjacent block. The first corner-base slant feature 13 and the second corner-base slant feature 35 are flat surfaces at a preferably 45-degree angle that enables optimal contact between the first corner-base elongated block 12 and the second corner-base block 35. The corner-base overlap feature 11 is terminally integrated into the first corner-base elongated block 12. In this way, the corner-base overlap feature 11 may extend to join with adjacent blocks. The first corner-base slant feature 13 is terminally integrated into the first corner-base elongated block 12, opposite the corner-base overlap feature 11. Moreover, the corner-base underlap feature 33 is terminally integrated into the second corner-base elongated block 34. In this way, the corner-base underlap feature 33 may extend to join with adjacent blocks. The second corner-base slant feature 35 is terminally integrated into the second corner-base elongated block 34, opposite the corner-base overlap feature 33. Thus, each of the plurality of corner-base block assemblies 9 is equipped to join appropriately to neighboring blocks on either end.

In addition, the first corner-base elongated block 12 is positioned perpendicular to the second corner-base elongated block 34. This arrangement enables the first corner-base slant feature 13 to align with the second corner-base slant feature 35, enabling connection or joining. The first corner-base slant feature 13 is engaged to the second corner-base slant feature 35. The first corner-base slant feature 13 and the second corner-base slant feature 35 are preferably flush against each other, enabling optimal connection and establishment of an appropriate right angle in the overall block arrangement.

The plurality of corner-base block assemblies 9 may join to an adjacent wall block by engaging with the adjacent wall block from below. To this end, the plurality of corner-base block assemblies 9 may comprise an arbitrary corner-base block assembly 14. The arbitrary corner-base block assembly 14 relates to any given block from the plurality of corner-base block assemblies 9. The plurality of intermediate-base blocks 1 may comprise an adjacent intermediate-base block 8. The corner-base underlap feature 33 of the arbitrary corner-base block 14 is engaged to an intermediate-base overlap connector 3 of the adjacent intermediate-base block 8. In this way, the corner-base underlap feature 33 may be oriented to link with an adjacent intermediate-base block 8 from underneath the intermediate-base overlap connector 3.

Similarly, the plurality of corner-base block assemblies 9 may join to an adjacent wall block by engaging with the adjacent wall block from above. To this end, the plurality of corner-base block assemblies 9 may comprise an arbitrary corner-base block assembly 14, as shown in FIG. 1. The plurality of intermediate-base blocks 1 may comprise an adjacent intermediate-base block 8. The corner-base overlap feature 11 of the arbitrary corner-base block 14 is engaged to an intermediate-base underlap connector 5 of the adjacent intermediate-base block 8. In this way, the corner-base overlap feature 11 may be oriented to link with an adjacent intermediate-base block 8 from above the intermediate-base underlap connector 5.

Figure 6:
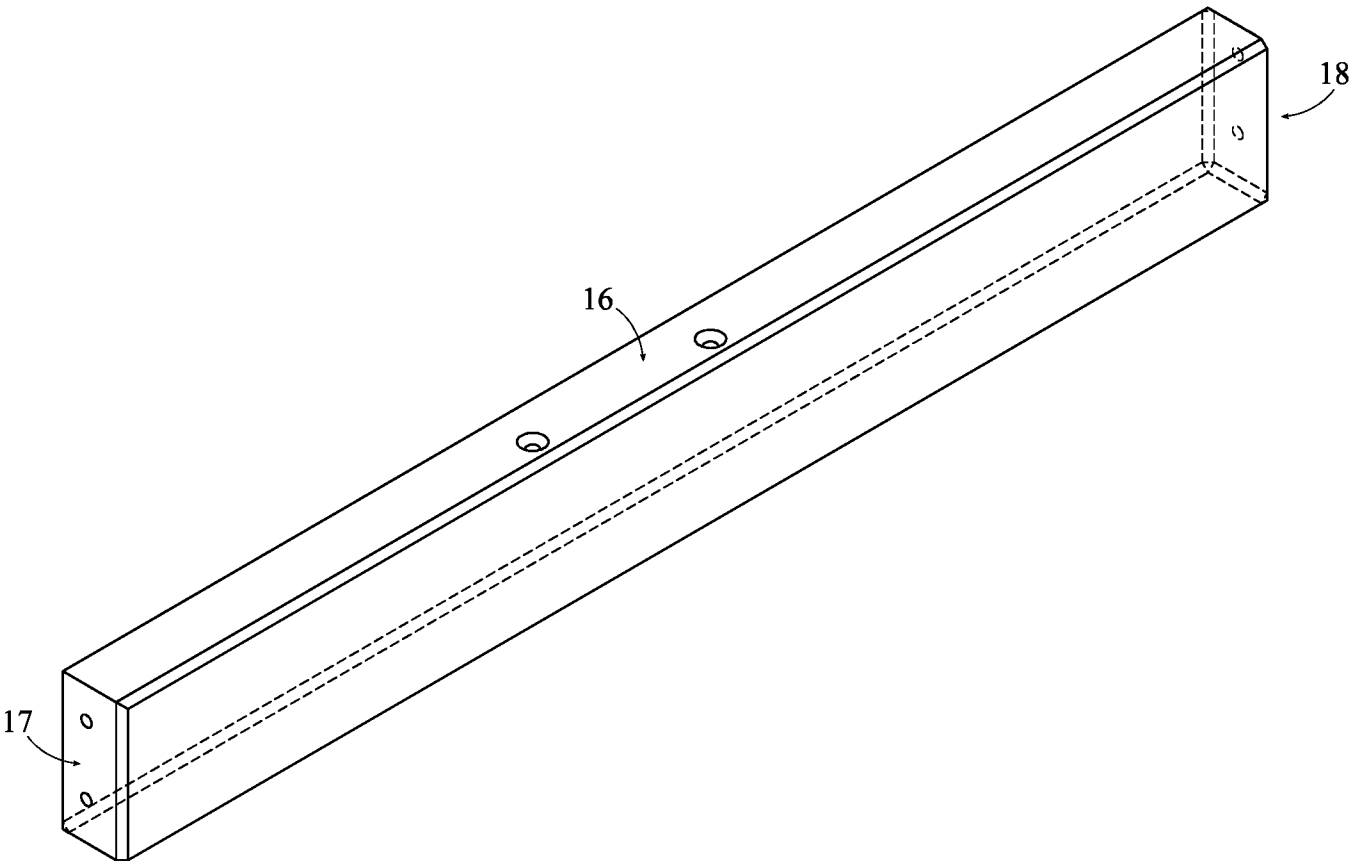
FIG. 6 is a top perspective view of an intermediate wall block of the present invention.

The plurality of intermediate-wall blocks 15 must be able to connect to adjacent blocks as necessary to secure each block in position. To achieve this, each of the plurality of intermediate-wall blocks 15 may comprise an intermediate-wall elongated body 16, a first intermediate-wall fastening feature 17, and a second intermediate-wall fastening feature 18, as shown in FIG. 6. The intermediate-wall elongated body 16 relates to the volume occupied by an intermediate-wall block of the plurality of intermediate-wall blocks 15. The first intermediate-wall fastening feature 17 is a connector that enables an intermediate-wall block of the plurality of intermediate-wall blocks 15 to join with another block. Similarly, the second intermediate-wall fastening feature 18 is a connector that enables an intermediate-wall block of the plurality of intermediate-wall blocks 15 to join with another block opposite the first intermediate-wall fastening feature 17. The first intermediate-wall fastening feature 17 is terminally integrated into the intermediate-wall elongated body 16. This arrangement enables the first intermediate-wall fastening feature 17 to join to another block in an end-to-end fashion. Similarly, the second intermediate-wall fastening feature 18 is terminally integrated into the intermediate-wall elongated body 16, opposite the first intermediate-wall fastening feature 17. This arrangement enables the second intermediate-wall fastening feature 18 to join to another block in an end-to-end fashion opposite the first intermediate-wall fastening feature 17.

It may be common for a block of the plurality of intermediate-wall blocks 15 to join with another block of the plurality of intermediate-wall blocks 15. To this end, the plurality of intermediate-wall blocks 15 may comprise an arbitrary intermediate-wall block 19 and an adjacent intermediate-wall block 20, as shown in FIG. 1. The arbitrary intermediate-wall block 19 relates to any given block of the plurality of intermediate-wall blocks 15. The adjacent intermediate-wall block 20 connotes a block of the plurality of intermediate-wall blocks 15 that is in contact with the arbitrary intermediate-wall block 19. The intermediate-wall elongated body 16 of the arbitrary intermediate-wall block 19 is positioned colinear to the intermediate-wall elongated body 16 of the adjacent intermediate-wall block 20. This arrangement ensures end-to-end contact of the arbitrary intermediate-wall block 19 with the adjacent intermediate-wall block 20. The first intermediate-wall fastening feature 17 of the arbitrary intermediate-wall block 19 is engaged to the second intermediate-wall fastening feature 18 of the adjacent intermediate-wall block 20. Thus, the arbitrary intermediate-wall block 19 may join to the adjacent intermediate-wall block 20, thereby preventing undesirable motion during setup and pouring of concrete.

It may also be common for a block of the plurality of intermediate-wall blocks 15 to join with a block of the plurality of corner-wall blocks 21. To enable this, the plurality of intermediate-wall blocks 15 may comprise an arbitrary intermediate-wall block 19, as shown in FIG. 1. Further, the plurality of corner-wall blocks 21 may comprise an adjacent corner-wall block. The adjacent corner-wall block 22 relates to a block of the plurality of corner-wall blocks 21 that is positioned proximal to and in contact with the arbitrary intermediate-wall block 19. The first intermediate-wall fastening feature 17 of the arbitrary intermediate-wall block 19 is engaged to a second corner-wall fastening feature 27 of the adjacent corner-wall block. The second corner-wall fastening feature 27 relates to a connector that prevents undesirable motion of the adjacent corner-wall block 22 relative to the arbitrary intermediate-wall block 19.

Figure 7:
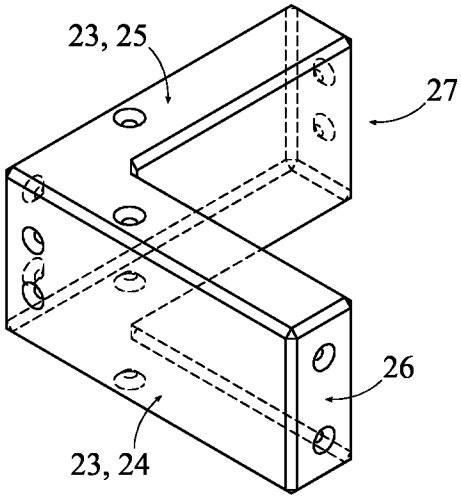
FIG. 7 is a top perspective view of a corner-wall block of the present invention.

Furthermore, a block of the plurality of intermediate-wall blocks 15 may join with a block of the plurality of corner-wall blocks 21 from the end opposite the first intermediate-wall fastening feature 17. To this end, the plurality of intermediate-wall blocks 15 may comprise an arbitrary intermediate-wall block 19. Further, the plurality of corner-wall blocks 21 may comprise an adjacent corner-wall block 22. The second intermediate-wall fastening feature 18 of the arbitrary intermediate-wall block 19 is engaged to a first corner-wall fastening feature 26 of the adjacent corner-wall block. The first corner-wall fastening feature 26, as shown in FIG. 7, relates to a connector that prevents undesirable motion of the adjacent corner-wall block 22 relative to the arbitrary intermediate-wall block 19.

The plurality of corner-wall blocks 21 may be pre-connected into a right-angle configuration, thus reducing assembly time. To achieve this, each of the plurality of corner-wall blocks 21 may comprise a corner-wall L-shaped body 23, a first corner-wall fastening feature 26, and a second corner-wall fastening feature 27, as shown in FIG. 7. The corner-wall L-shaped body 23 relates to the volume occupied by each of the plurality of corner-wall blocks 21, particularly when arranged into a right-angle. The first corner-wall fastening feature 26 is a connector that allows each of the plurality of corner-wall blocks 21 to connect to an adjacent block. Similarly, second corner-wall fastening feature 27 is a connector that allows each of the plurality of corner-wall blocks 21 to connect to an adjacent block, opposite the first corner-wall fastening feature. The corner-wall L-shaped body 23 may comprise a first leg portion 24 and a second leg portion 25. The first leg portion 24 relates to a rigid segment extending from the corner-wall L-shaped body 23. Similarly, the second leg portion 25 relates to a rigid segment extending from the corner-wall L-shaped body 23, opposite the first leg portion 24. The first leg portion 24 and the second leg portion 25 are terminally positioned to each other. This arrangement enables the first leg portion 24 and the second leg portion 25 to extend into perpendicular directions from a shared connection point. The first corner-wall fastening feature 26 is terminally integrated into the first leg portion 24, opposite the second leg portion 25. This arrangement allows the first corner-wall fastening feature 26 to connect end-to-end with an adjacent block. Similarly, the second corner-wall fastening feature 27 is terminally integrated into the second leg portion 25, opposite the first leg portion 24. Thus, the second corner-wall fastening feature 27 can connect end-to-end with an adjacent block.

Different blocks may connect to the first corner-wall fastening feature 26 upon the first leg portion 24. To this end, the plurality of corner-wall blocks 21 may comprise an arbitrary corner-wall block 28, as shown in FIG. 1. The arbitrary corner-wall block 28 relates to any given corner-wall block from the plurality of corner-wall blocks 21. The plurality of intermediate-wall blocks 15 may comprise an adjacent intermediate-wall block 20. The first leg portion 24 of the arbitrary corner-wall block 28 is positioned colinear to the adjacent intermediate-wall block 20. This arrangement enables the first leg portion 24 to connect end-to-end to the adjacent intermediate-wall block 20. The first corner-wall fastening feature 26 of the arbitrary corner-wall block 28 is engaged to a second intermediate-wall fastening feature 18 of the adjacent intermediate-wall block 20. The second intermediate-wall fastening feature 18 relates to the connector that joins blocks to the first leg portion 24 of the arbitrary corner-wall block 28. In this way, the first leg portion 24 may connect to the adjacent intermediate-wall block 20 via the first corner-wall fastening feature.

Similarly, blocks may connect to the second corner-wall fastening feature 27 upon the second leg portion 25. To this end, the plurality of corner-wall blocks 21 may comprise an arbitrary corner-wall block 28, as shown in FIG. 1. The plurality of intermediate-wall blocks 15 may comprise an adjacent intermediate-wall block 20. The second leg portion 25 of the arbitrary corner-wall block 28 is positioned colinear to the adjacent intermediate-wall block 20. This arrangement enables the second leg portion 25 to connect end-to-end to the adjacent intermediate-wall block 20. The second corner-wall fastening feature 27 of the arbitrary corner-wall block 28 is engaged to a first intermediate-wall fastening feature 17 of the adjacent intermediate-wall block 20. The first intermediate-wall fastening feature 17 relates to the connector that joins blocks to the second leg portion 25 of the arbitrary corner-wall block 28. In this way, the second leg portion 25 may connect to the adjacent intermediate-wall block 20 via the second corner-wall fastening feature 27.

The present invention is optimized through the ability of the various block components to form a solid perimeter wall into which concrete may be poured. To enable this, each of the plurality of intermediate-base blocks 1, each of the plurality of corner-base block assemblies 9, each of the plurality of intermediate-wall blocks 15, and each of the plurality of corner-wall blocks 21 may be made of reinforced concrete. The reinforced concrete ensures that each of the plurality of intermediate-base blocks 1, each of the plurality of corner-base block assemblies 9, each of the plurality of intermediate-wall blocks 15, and each of the plurality of corner-wall blocks 21 are heavy enough to prevent shifting during concrete pouring and subsequent expansion during hardening.

It may further be beneficial to pre-stress the concrete, in order to ensure the integrity of the inner wall that forms the concrete mold. To this end, the reinforced concrete may be configured into a post-tensioned state. Thus, the reinforced concrete cannot bend during arrangement of blocks or during concrete pouring or hardening processes.

Although the invention has been explained in relation to its preferred embodiment, it is to be understood that many other possible modifications and variations can be made without departing from the spirit and scope of the invention as hereinafter claimed.

What is claimed is:

1. A system of stem wall foundation blocks comprises:

a plurality of intermediate-base blocks;

a plurality of corner-base block assemblies;

a plurality of intermediate-wall blocks;

a plurality of corner-wall blocks;

the plurality of intermediate-base blocks and the plurality of corner-base block assemblies being arranged into a rectangular base enclosure, wherein the rectangular base enclosure comprises a plurality of base enclosure vertices;

the plurality of intermediate-base blocks being positioned in between the plurality of base enclosure vertices;

the plurality of corner-base block assemblies being positioned at the plurality of base enclosure vertices;

the plurality of intermediate-wall blocks and the plurality of corner-wall blocks being arranged into a rectangular wall enclosure, wherein the rectangular wall enclosure comprises a plurality of wall enclosure vertices;

the plurality of intermediate-wall blocks being positioned in between the plurality of wall enclosure vertices;

the plurality of corner-wall blocks being positioned at the plurality of wall enclosure vertices; and the rectangular wall enclosure being mounted onto the rectangular base enclosure;

each of the plurality of intermediate-base blocks comprises an intermediate-base elongated body, an intermediate-base overlap connector, and an intermediate-base underlap connector;

the intermediate-base overlap connector being terminally integrated into the intermediate-base elongated body;

the intermediate-base underlap connector being terminally integrated into the intermediate-base elongated body, opposite the intermediate-base overlap connector;

each of the plurality of corner-base block assemblies comprises a first corner-base elongated block, a second corner-base elongated block, a corner-base overlap feature, a corner-base underlap feature, a first corner-base slant feature, and a second corner-base slant feature;

the corner-base overlap feature being terminally integrated into the first corner-base elongated block;

the first corner-base slant feature being terminally integrated into the first corner-base elongated block, opposite the corner-base overlap feature;

the corner-base underlap feature being terminally integrated into the second corner-base elongated block;

the second corner-base slant feature being terminally integrated into the second corner-base elongated block, opposite the corner-base underlap feature;

the first corner-base elongated block being positioned perpendicular to the second corner-base elongated block;

the first corner-base slant feature being engaged to the second corner-base slant feature;

the intermediate-base overlap connector comprises a plurality of recessed channels;

the intermediate-base underlap connector comprises a plurality of elongated protrusions;

each of the plurality of recessed channels and each of the plurality of elongated protrusions being positioned parallel to the intermediate-base elongated body;

the plurality of recessed channels being distributed across the intermediate-base overlap connector;

the plurality of elongated protrusions being distributed across the intermediate-base underlap connector;

each of the plurality of elongated protrusions being sized to coextensively fit into a corresponding channel from the plurality of recessed channels;

the plurality of elongated protrusions being quantitatively equal to the plurality of recessed channels;

each of the plurality of intermediate-base blocks, each of the plurality of corner-base block assemblies, each of the plurality of intermediate-wall blocks, and each of the plurality of corner-wall blocks being made of reinforced concrete; and the reinforced concrete being configured into a post-tensioned state.

2. The system of stem wall foundation blocks as claimed in claim 1 comprises:

the plurality of intermediate-base blocks comprises an arbitrary intermediate-base block and an adjacent intermediate-base block;

the intermediate-base elongated body of the arbitrary intermediate-base block being positioned colinear to the intermediate-base elongated body of the adjacent intermediate-base block; and the intermediate-base overlap connector of the arbitrary intermediate-base block being engaged to the intermediate-base underlap connector of the adjacent intermediate-base block.

3. The system of stem wall foundation blocks as claimed in claim 1 comprises:

the plurality of intermediate-base blocks comprises an arbitrary intermediate-base block;

the plurality of corner-base block assemblies comprises an adjacent corner-base block assembly;

the intermediate-base overlap connector of the arbitrary intermediate-base block being engaged to the corner-base underlap feature of the adjacent corner-base block assembly.

4. The system of stem wall foundation blocks as claimed in claim 1 comprises:

the plurality of intermediate-base blocks comprises an arbitrary intermediate-base block;

the plurality of corner-base block assemblies comprises an adjacent corner-base block assembly; and the intermediate-base underlap connector of the arbitrary intermediate-base block being engaged to the corner-base overlap feature of the adjacent corner-base block assembly.

5. The system of stem wall foundation blocks as claimed in claim 1 comprises:

the plurality of corner-base block assemblies comprises an arbitrary corner-base block assembly;

the plurality of intermediate-base blocks comprises an adjacent intermediate-base block; and the corner-base underlap feature of the arbitrary corner-base block assembly being engaged to the intermediate-base overlap connector of the adjacent intermediate-base block.

6. The system of stem wall foundation blocks as claimed in claim 1 comprises:

the plurality of corner-base block assemblies comprises an arbitrary corner-base block assembly;

the plurality of intermediate-base blocks comprises an adjacent intermediate-base block; and the corner-base overlap feature of the arbitrary corner-base block assembly being engaged to an intermediate-base underlap connector of the adjacent intermediate-base block.

7. The system of stem wall foundation blocks as claimed in claim 1 comprises:

each of the plurality of intermediate-wall blocks comprises an intermediate-wall elongated body, a first intermediate-wall fastening feature, and a second intermediate-wall fastening feature;

the first intermediate-wall fastening feature being terminally integrated into the intermediate-wall elongated body; and the second intermediate-wall fastening feature being terminally integrated into the intermediate-base elongated body, opposite the first intermediate-wall fastening feature.

8. The system of stem wall foundation blocks as claimed in claim 7 comprises:

the plurality of intermediate-wall blocks comprises an arbitrary intermediate-wall block and an adjacent intermediate-wall block;

the intermediate-wall elongated body of the arbitrary intermediate-wall block being positioned colinear to the intermediate-wall elongated body of the adjacent intermediate-wall block; and the first intermediate-wall fastening feature of the arbitrary intermediate-wall block being engaged to the second intermediate-wall fastening feature of the adjacent intermediate-wall block.

9. The system of stem wall foundation blocks as claimed in claim 7 comprises:

the plurality of intermediate-wall blocks comprises an arbitrary intermediate-wall block;

the plurality of corner-wall blocks comprises an adjacent corner-wall block; and the first intermediate-wall fastening feature of the arbitrary intermediate-wall block being engaged to a second corner-wall fastening feature of the adjacent corner-wall block.

10. The system of stem wall foundation blocks as claimed in claim 7 comprises:

the plurality of intermediate-wall blocks comprises an arbitrary intermediate-wall block;

the plurality of corner-wall blocks comprises an adjacent corner-wall block; and the second intermediate-wall fastening feature of the arbitrary intermediate-wall block being engaged to a first corner-wall fastening feature of the adjacent corner-wall block.

11. The system of stem wall foundation blocks as claimed in claim 1 comprises:

each of the plurality of corner-wall blocks comprises a corner-wall L-shaped body, a first corner-wall fastening feature, and a second corner-wall fastening feature;

the corner-wall L-shaped body comprises a first leg portion and a second leg portion;

the first leg portion and the second leg portion being terminally positioned to each other;

the first corner-wall fastening feature being terminally integrated into the first leg portion, opposite the second leg portion; and the second corner-wall fastening feature being terminally integrated into the second leg portion, opposite the first leg portion.

12. The system of stem wall foundation blocks as claimed in claim 11 comprises:

the plurality of corner-wall blocks comprises an arbitrary corner-wall block;

the plurality of intermediate-wall blocks comprises an adjacent intermediate-wall block;

the first leg portion of the arbitrary corner-wall block being positioned colinear to the adjacent intermediate-wall block; and the first corner-wall fastening feature of the arbitrary corner-wall block being engaged to a second intermediate-wall fastening feature of the adjacent intermediate-wall block.

13. The system of stem wall foundation blocks as claimed in claim 11 comprises:

the plurality of corner-wall blocks comprises an arbitrary corner-wall block;

the plurality of intermediate-wall blocks comprises an adjacent intermediate-wall block;

the second leg portion of the arbitrary corner-wall block being positioned colinear to the adjacent intermediate-wall block; and the second corner-wall fastening feature of the arbitrary corner-wall block being engaged to a first intermediate-wall fastening feature of the adjacent intermediate-wall block.

* * * * *